US008803752B2

(12) United States Patent
Lee

(10) Patent No.: US 8,803,752 B2
(45) Date of Patent: Aug. 12, 2014

(54) OMNIDIRECTIONAL ANTENNA

(76) Inventor: Sung-Chul Lee, Pyeongtaek-si (KR)

( * ) Notice: Subject to any disclaimer, the term of this patent is extended or adjusted under 35 U.S.C. 154(b) by 431 days.

(21) Appl. No.: 12/525,308

(22) PCT Filed: Jan. 23, 2008

(86) PCT No.: PCT/KR2008/000420

§ 371 (c)(1),
(2), (4) Date: Jul. 30, 2009

(87) PCT Pub. No.: WO2008/093959

PCT Pub. Date: Aug. 7, 2008

(65) Prior Publication Data

US 2010/0026599 A1 Feb. 4, 2010

(30) Foreign Application Priority Data

Feb. 2, 2007 (KR) ..... 10-2007-0010899

(51) Int. Cl.
*H01Q 1/36* (2006.01)
*H01Q 9/06* (2006.01)

(52) U.S. Cl.
USPC ..... 343/790; 343/895

(58) Field of Classification Search
USPC ..... 343/702, 742, 873, 895, 790
See application file for complete search history.

(56) References Cited

U.S. PATENT DOCUMENTS

| | | | | | |
|---|---|---|---|---|---|
| 4,375,642 | A | * | 3/1983 | Dorrie et al. | 343/895 |
| 5,346,300 | A | | 9/1994 | Yamamoto et al. | |
| 5,854,608 | A | * | 12/1998 | Leisten | 343/895 |
| 5,945,963 | A | | 8/1999 | Leisten | |
| 5,977,931 | A | * | 11/1999 | Openlander | 343/895 |
| 5,986,620 | A | * | 11/1999 | Filipovic | 343/895 |
| 6,853,352 | B2 | * | 2/2005 | Nevermann et al. | 343/895 |
| 6,985,122 | B2 | * | 1/2006 | Cohen | 343/793 |
| 2003/0140480 | A1 | | 7/2003 | Leisten et al. | |
| 2006/0109196 | A1 | | 5/2006 | Liu et al. | |

* cited by examiner

*Primary Examiner* — Michael C Wimer
(74) *Attorney, Agent, or Firm* — Christopher Paul Mitchell

(57) ABSTRACT

The omnidirectional antenna of the present invention comprises a dielectric core 20 of ceramic material which has a longitudinal hole 21 formed in the center; a strip line 30 which is bent to fit the circumference of the dielectric core 20 by a press-forming method and is covered over the upper outer circumference of the dielectric core; a lower cap 40 which is inserted over the bottom end of the dielectric core and has a hole formed at the center of the bottom; a feeder 50 which is passed through and inserted from down to up into the holes formed in the bottom cap and the dielectric core and the top end of which is connected with the strip line 30 on the upper surface of the dielectric core; and a strip line fixing means 60 for combining the lower cap and strip line to the dielectric core.

6 Claims, 3 Drawing Sheets

OMNIDIRECTIONAL ANTENNA

RELATED APPLICATIONS

This application is a 371 application of International Application No. PCT/KR2008/000420, filed Jan. 23, 2008, which in turn claims priority from Korean Patent Application No. 10-2007-0010899, filed Feb. 2, 2007, both of which are incorporated herein by reference.

TECHNICAL FIELD

The present invention relates to an omnidirectional antenna, and more specifically to an omnidirectional antenna in which the material of dielectric, which is the body of antenna, is improved and a feeder is made to pass through the middle of the dielectric, and also the electrical pattern is improved to shorten the processing time and mass production is made possible to lower the price.

BACKGROUND ART

In general, a conventional omnidirectional antenna comprises a dielectric core made of cylindrical ceramic, an electrical pattern line painted around the outer of the dielectric core in a spiral form, a conductive sleeve which is provided below the dielectric core and is connected with the pattern line, and an outer conductor which is passed through a hole formed in the dielectric core in contact with the conductive sleeve and connected with the top end of the painted line.

However, because the conventional antenna as described above is constructed by painting the electrical pattern line on the surface of the dielectric core, it has to be post-processed by adding plasticity processing, natural drying, or etching or laser processing after plating. Because of this, it has disadvantages of decreased productivity and increased production cost since a lot of processing time is consumed.

DISCLOSURE OF INVENTION

Technical Problem

Therefore, the present invention is to solve such conventional problems with an object to provide an omnidirectional antenna, comprising a cylindrical or square dielectric core made of dielectric; a strip line of square wave or saw wave shape, which is a press-formed object made of material of copper plate, silver plate or nickel plate and covers the outer circumference over the dielectric core, and in which electricity is supplied to the cable at the top end through a feeder; and a cap which has a structure of a can shape covered over the bottom end of the dielectric core; and whereby productivity can be increased and production cost can be lowered by inserting the feeder into the hole formed in the dielectric core and the cap, and then soldering and fixing it with a thermal shrinkage tube.

Technical Solution

In order to accomplish the object of the present invention, there is provided an omni-directional antenna comprising: a dielectric core of ceramic material which has a longitudinal hole formed in the center; a strip line which is bent to fit the circumference of the dielectric core by a press-forming method and is covered over the upper outer circumference of the dielectric core; a lower cap which is inserted over the bottom end of the dielectric core and has a hole formed at the center of the bottom; a feeder as a current feeding means which is passed through and inserted from down to up into the holes formed in the bottom cap and the dielectric core and the top end of which is connected with the strip line on the upper surface of the dielectric core; and a strip line fixing means for combining the lower cap and the strip line to the dielectric core.

Preferably, the strip line fixing means is a thermal shrinkage tube for combining the lower cap and the strip line to the dielectric core.

Preferably, the strip line is formed on the surface of the dielectric core by a plating method.

Preferably, the strip line is formed on the dielectric core by a painting method.

Advantageous Effects

In accordance with the present invention, productivity is excellent according to the present invention, because a cylindrical or square dielectric core made of dielectric is prepared and subsequently a strip line of square wave or saw wave shape is made of material of copper plate, silver plate or nickel plate. In particular, after inserting a cap over the bottom end of the dielectric core, a feeder, which is a current feeding means, is passed through the cap and dielectric core, and then the top end of the feeder is connected with the strip line, and the strip line is fixed to the dielectric core with a thermal shrinkage tube. Therefore, productivity is high and production cost can be lowered greatly.

BRIEF DESCRIPTION OF THE DRAWINGS

These and other objects, features, aspects, and advantages of preferred embodiments of the present invention will be more fully described in the following detailed description, taken in conjunction with the accompanying drawings. In the drawings.

DESCRIPTION OF SYMBOLS OF THE MAJOR PARTS OF THE DRAWINGS

Figure 1:
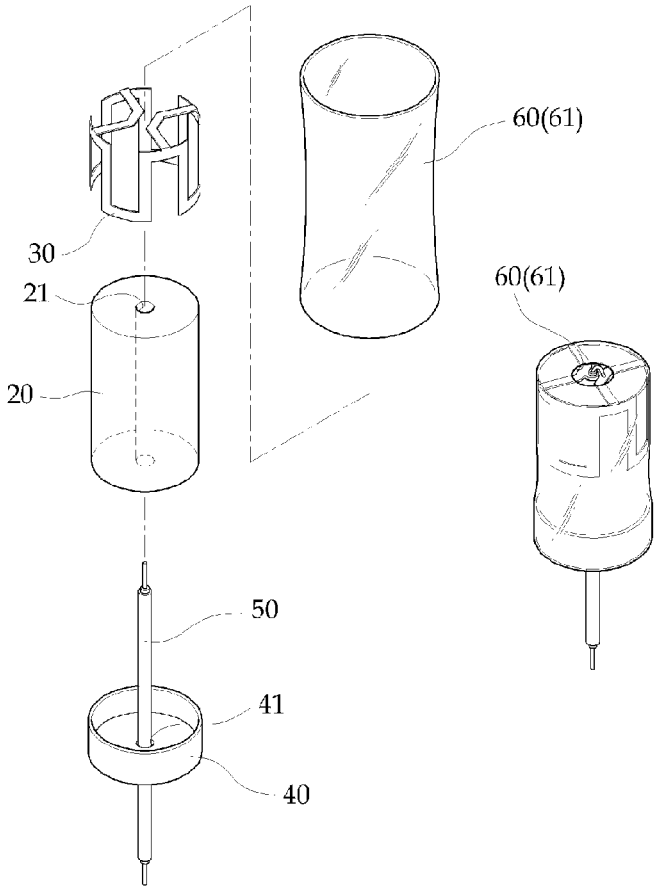
FIG. 1 is an exploded perspective view of an omnidirectional antenna according to an embodiment of the present invention.

20: dielectric core
30: strip line
41: hole
60: strip line fixing means
21: hole
40: lower cap
50: feeder
61: thermal shrinkage tube

BEST MODE FOR CARRYING OUT THE INVENTION

Below will be described in detail the construction and action of the present invention with reference to the accompanying drawings.

Figure 2:
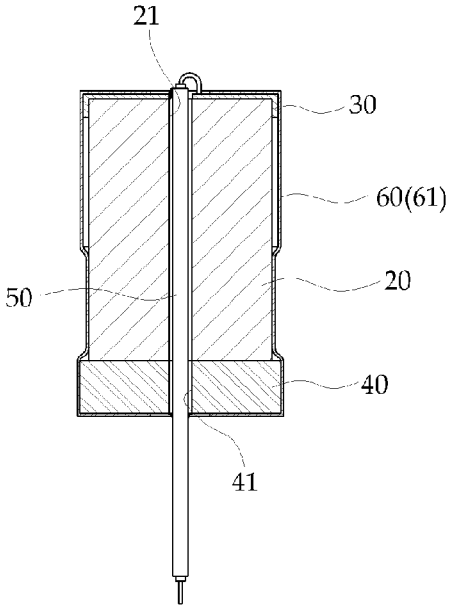
FIG. 2 is a sectional view of the omnidirectional antenna shown in FIG. 1.

FIG. 1 is an exploded perspective view of an omnidirectional antenna according to an embodiment of the present invention, and FIG. 2 is a sectional view of the omni-directional antenna shown in FIG. 1.

As shown in the drawings, the omnidirectional antenna of the present invention consists generally of a dielectric core 20, strip line 30, lower cap 40, feeder 50 as a current feeding means, and strip line fixing means 60.

The dielectric core 20 is made of ceramic material, and in general it is formed in a cylinder form shown in the drawing. But the dielectric core may be formed as a square column, and in the center of it is formed a hole 41 into which a feeder 50 serving as a current feeding means is inserted.

A strip line 30, which covers the upper outer circumference of the dielectric core 20, is made of material of copper plate, silver plate or nickel plate. It is preferable to form the strip line 30 on the surface of the dielectric core 20 by a plating or painting method. The biggest characteristic of the strip line 30 is that it is formed in a shape of square wave or saw wave by the method of press-forming. After press-forming, it is bent into a shape of cylinder or square column to fit the shape of the outer circumference of the dielectric core 20.

And the lower cap 40 provided at the bottom end of the dielectric core 20 has an inner diameter of such a size as to be inserted over the dielectric core 20 and has a hole 41 formed at the center of the bottom.

The feeder 50 is passed through and inserted from down to up into the hole 41 formed in the lower cap 40 and the longitudinal hole 21 formed in the dielectric core 20, then it is connected with the strip line 30 on the upper surface of the dielectric core 20.

In the method of connecting with the strip line, each line is connected so as to cross at right angles (90°), as shown in the drawings showing the various embodiments of the present invention.

Figure 3:
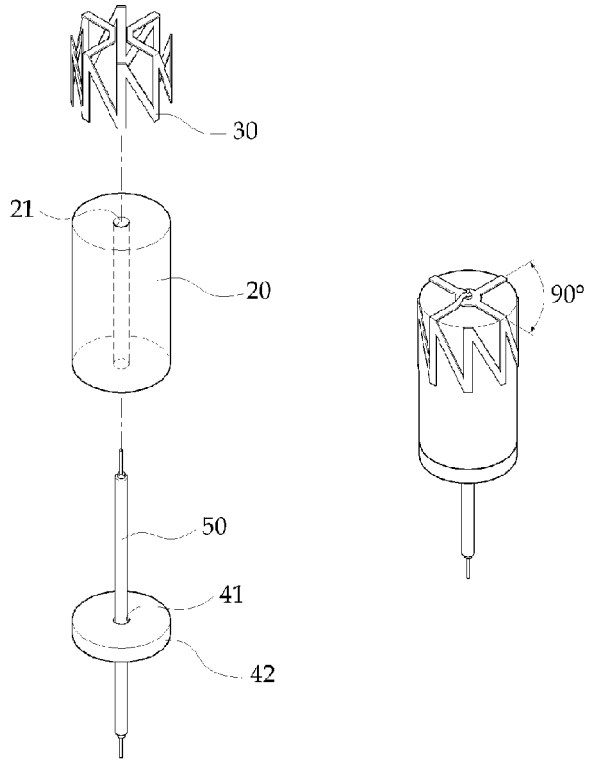
FIG. 3 is an exploded perspective view showing an omnidirectional antenna according to another embodiment of the present invention.
Figure 4:
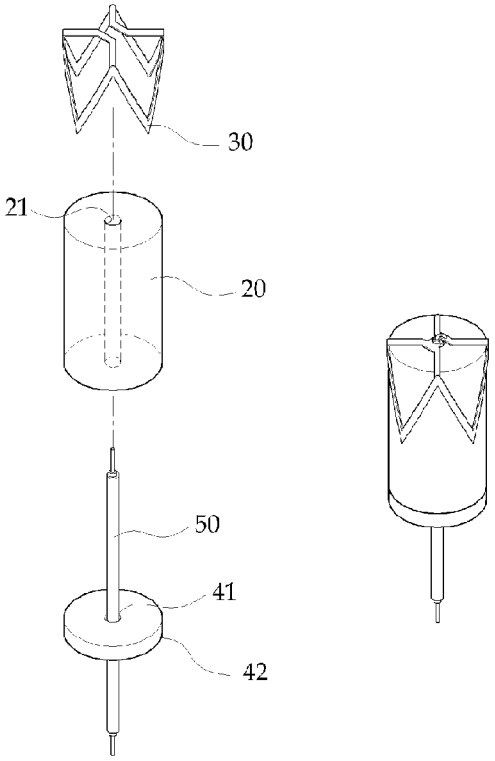
FIG. 4 is an exploded perspective view showing an omnidirectional antenna according to yet another embodiment of the present invention.
Figure 5:
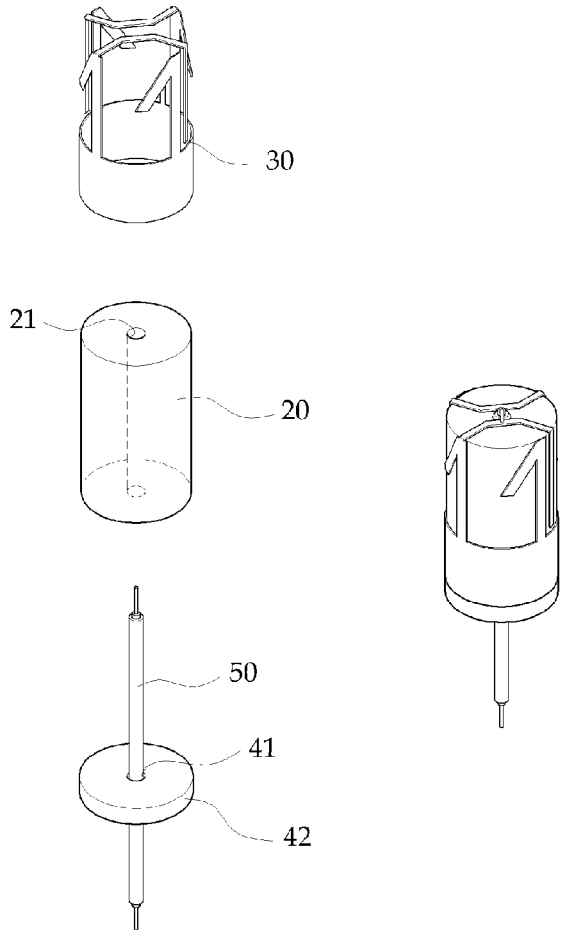
FIG. 5 is an exploded perspective view showing an omnidirectional antenna according to still another embodiment of the present invention.

And the lower cap 40 may be substituted by a disk 42, as shown in FIGS. 3 to 5.

Next, another characteristic of the present invention is using a thermal shrinkage tube 61 as a strip line fixing means 60. This thermal shrinkage tube 61 maintains the original diameter sufficiently before it is heated as is well known. If the strip line 30 is inserted over the upper outer circumference of the dielectric core 20 and heated with the heat shrinkage tube 61 covered over it, the diameter of the tube is shrunk by heat so as to come into close contact with the outer circumference of the core, so that the strip line 30 can be fixed to the dielectric core 20.

Meanwhile, the strip line 30 of the present invention can be made into a given pattern by painting in electronic ink (conductive material).

Not only that, the strip line 30 of the present invention can be also made by the method of plating (copper, silver, gold, etc.) only the pattern line.

To assemble antennas of the present invention made like this, the dielectric core 20 is produced and supplied separately as is done conventionally.

And the strip line 30 is produced and supplied separately through the new press finishing and bending methods, and also the lower cap 40 is supplied through a cutting process such as press finishing or use of a CNC lathe.

When the feeder 50 is prepared as well, it is passed through into the holes 21 and 41 of the lower cap 40 and dielectric core 20, and then it is made into one unit by joining them by soldering, etc.

Subsequently, the strip line fixing means 60, that is, the thermal shrinkage tube 61, is covered over the strip line 30 and dielectric core 20 and heat is applied. The strip line 30 is fixed firmly on the outer surface of the dielectric core 20 by the heat shrinkage tube 61.

In the present invention the strip line 30 is formed in a shape of square wave or saw wave. Also, the number of lines can be made by selecting diversely within the range of 4 to 8 so as to widen the frequency band.

Because the strip line of the antenna according to the present invention crosses at right angles (90°), it has characteristics that it can receive circularly polarized waves and omnidirectional reception is possible.

INDUSTRIAL APPLICABILITY

As described above, productivity is excellent according to the present invention, because a cylindrical or square dielectric core made of dielectric is prepared and subsequently a strip line of square wave or saw wave shape is made of material of copper plate, silver plate or nickel plate. In particular, after inserting a cap over the bottom end of the dielectric core, a feeder, which is a current feeding means, is passed through the cap and dielectric core, and then the top end of the feeder is connected with the strip line, and the strip line is fixed to the dielectric core with a thermal shrinkage tube. Therefore, productivity is high and production cost can be lowered greatly.

A preferred embodiment of the present invention will now be described in detail with reference to the accompanying drawings. In the following description, well-known functions or constructions are not described in detail since they would obscure the invention in unnecessary detail, and therefore, a detailed description thereof will be omitted.

The invention claimed is:

1. An omni-directional antenna, comprising:

a cylindrical dielectric core;

strip lines disposed on an upper outer circumference and a top of the cylindrical dielectric core;

a lower cap fitted from a bottom of the bottom of the cylindrical dielectric core thereon; and a feeder passing through the cylindrical dielectric core along a central axis thereof to electrically connect the strip lines, wherein the strip lines disposed on the upper outer circumference of the cylindrical dielectric core comprise an arrangement of a plurality of V shaped structures extended along a horizontal direction, wherein the arrangement of the plurality of V shaped structures surrounds an entirety of the upper circumference of the cylindrical dielectric core, and wherein the strip lines disposed on the upper outer circumference of the cylindrical dielectric core are separated from the lower cap on a lower outer circumference of the cylindrical dielectric core.

2. The omni-directional antenna of claim 1, wherein the arrangement of the plurality of V shaped structures comprises four V shaped structures.

3. The omni-directional antenna of claim 2, wherein the strip lines disposed on the upper outer circumference of the cylindrical dielectric core extend from respective peaks of the V shaped structures to a portion of the of the feeder extending out of a center of the top of the cylindrical dielectric core.

4. The omni-directional antenna of claim 3, wherein a portion of the strip lines disposed on the top of the cylindrical dielectric core is at a 90 degree angle horizontally with respect to a portion of the strip lines disposed on the upper outer circumference of the cylindrical dielectric core.

5. The omni-directional antenna of claim 1, wherein the arrangement of the plurality of V shaped structures comprises eight V shaped structures.

6. The omni-directional antenna of claim 1, further comprising a thermal shrinkage tube disposed on an outer circumference of the cylindrical dielectric core for combining the lower cap and the strip lines to the cylindrical dielectric core.

* * * * *